US006053275A

United States Patent [19]

Leonetti et al.

[11] Patent Number: 6,053,275

[45] **Date of Patent: *Apr. 25, 2000**

[54] ACOUSTICAL ABSORBER ARRAY

[75] Inventors: John T. Leonetti; Mark B. Sutherland, both of Peoria; Emile E. Damotte, Pekin, all of Ill.

[73] Assignee: Caterpillar Inc., Peoria, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/158,366

[22] Filed: Sep. 22, 1998

Related U.S. Application Data

[60] Provisional application No. 60/093,629, Jul. 21, 1998.

[51] Int. Cl.[7] ..... G10K 11/04

[52] U.S. Cl. ..... 181/200; 181/202; 181/207

[58] Field of Search ..... 181/200, 202, 181/203, 204, 205, 207, 208, 209, 290, 294, 295

[56] References Cited

U.S. PATENT DOCUMENTS

| | | | |
|---|---|---|---|
| 4,195,713 | 4/1980 | Hagbjer et al. | 181/208 |
| 4,215,763 | 8/1980 | Pasko | 181/202 |
| 4,778,028 | 10/1988 | Staley | 181/208 |

OTHER PUBLICATIONS

Area and Pattern Effects in the Measurement of Sound Absorption by John Parkinson; Journal of the Acoustical Society; Jul. 1930; p. 112–22.

*Primary Examiner*—Khanh Dang

*Attorney, Agent, or Firm*—Steven G. Kibby

[57] ABSTRACT

A plurality of acoustical absorption elements are mounted in a two-dimensional spaced array on an acoustically reflective surface of an machinery enclosure, in such a manner as to expose portions of the reflective surface between neighboring elements. The elements are preferably of a substantially standard size and shape in order to enhance production and inventory efficiency, although materials of various thickness may be provided to accommodate tuning for specific frequencies to be absorbed.

20 Claims, 1 Drawing Sheet

ACOUSTICAL ABSORBER ARRAY

This application is based on the material disclosed in United States provisional patent application Ser. No. 60/093,629 filed Jul. 21, 1998.

TECHNICAL FIELD

The present invention relates to improvements in sound absorption of reverberant energy, and more particularly, to the arrangement of acoustical absorbent elements in a two-dimensional spaced array on reflective surfaces of an machinery enclosure for reduction of reverberant energy.

BACKGROUND ART

Enclosures for internal combustion engines, hydraulic pumps, and cooling fans, such as those used on mobile machines and electrical power generation units, are typically formed of sheet metal or rigid fiberglass or polymer walls. These machinery enclosures are designed both to shield the machinery from weather and debris, and contain the sound produced by the machinery. Typically reduction of sound levels outside the enclosure is accomplished by absorbing sound waves traveling through any air inlet or exit ports supporting combustion and cooling, as well as substantially covering the interior walls with sound absorbing materials to reduce reverberant energy.

Reverberant energy is the cumulative sound energy within the enclosure over time, made up of both the acoustic energy currently produced by the machinery and any previously produced acoustic energy reflecting around the enclosure which has not yet decayed to a negligible level. Although some acoustic energy escapes through openings in the enclosure, such release partially defeats the purpose of the enclosure and is limited by noise regulations. It is generally accepted that for an engine within a seventy percent closed enclosure, due to reverberation the measured interior sound energy will often be double that which is produced by the engine directly. Accordingly, the rate of decay and hence the reverberant energy within the enclosure, is highly dependent upon the absorption of sound energy.

Absorption occurs through viscous damping, in which acoustical energy is transformed by friction into heat as it travels through an acoustical absorbent material. By attaching large panels of acoustical absorbent material to substantially cover each major interior reflecting surface of the enclosure, it was believed that the optimum absorption is obtained within the available area for a given type and thickness of absorbent material. The large panels are typically of rather dense materials in order to maintain structural integrity, and are individually fitted to each size and shape of machinery enclosure, resulting in high design, tooling and inventory costs.

DISCLOSURE OF THE INVENTION

In one aspect of the present invention, a plurality of acoustical absorption elements are disclosed mounted in a two-dimensional spaced array on at least one acoustically reflective surface of an machinery enclosure, wherein portions of the surface are exposed between neighboring elements. The elements are preferably of a substantially standard size and shape in order to enhance production and inventory efficiency, although materials of various thickness may be provided to accommodate tuning for specific frequencies to be absorbed.

The acoustical absorption elements may include structure for removable attachment to the enclosure surface, such as a magnetic material or hook and loop arrangement, to permit cleaning or replacement of the elements. Fiberglass batting is a preferred material for the absorbent elements due to its ability to withstand heat generated in the compartment, although various foams such as open cell polyurethane may also be utilized.

In a presently preferred embodiment, the elements are elliptical or rectangular in shape and have a constant thickness of about one to two inches. Alternatively, some or all of the elements may be formed to present the surface opposite the mounting face at an oblique angle to the reflecting surface of the enclosure. Preferably a major dimension of each element is at least six inches and the inter element spacing does not exceed one third of the major dimension. Total exposed surface area of the plurality of absorbent elements mounted to an enclosure wall is preferably greater than the interior wall surface area.

Other details and advantages of the invention will become apparent by reference to the following description and illustrative drawings of certain present embodiments thereof and certain present preferred methods of practicing the same proceeds.

BRIEF DESCRIPTION OF THE DRAWINGS

Illustrate examples of this invention are provided in the accompanying drawings, in which like reference symbols indicate the same or similar components, wherein.

BEST MODE FOR CARRYING OUT THE INVENTION

It has long been recognized that the area and arrangement of absorbent material had a bearing on the coefficient of absorption obtained. In the July, 1930 *Journal of the Acoustical Society,* John S. Parkinson published the results of his experiments indicating that by spacing small areas of acoustic treatment at a little distance from one another, increased absorption may be obtained from a given area of absorbent treatment. Despite this finding, common practice today is still to essentially cover large reflecting surfaces in an machinery enclosure with large sheets of custom-shaped acoustic treatment.

Figure 1:
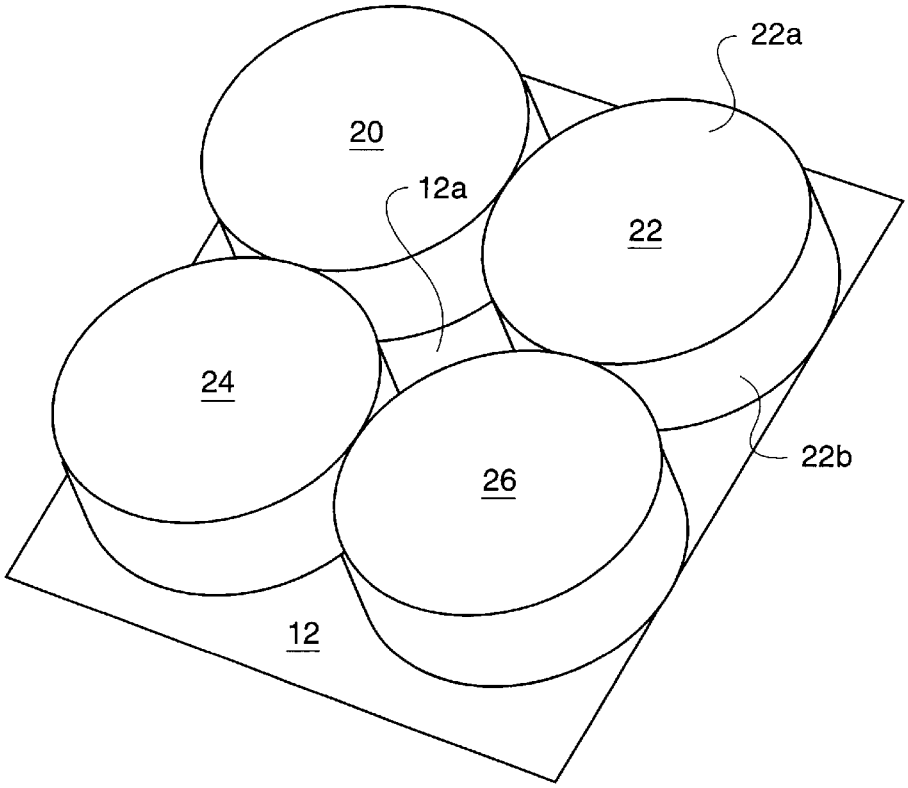
FIG. 1 is illustrative of a plurality of acoustical absorption elements mounted in a two-dimensional spaced array on a reflective surface.

Turning now to the drawings and referring first to FIG. 1, a system 10 for attenuating sound reverberations within an machinery enclosure is illustrated, having a plurality of acoustical absorption elements 20,22,24 and 26 mounted in a two-dimensional spaced array on a acoustically reflective machinery enclosure surface 12 forming an enclosure wall. As used herein, the term two-dimensional spaced array means that at least some absorption elements are spaced in the direction of a first axis while others are spaced in the direction of a a second axis perpendicular to the first axis. Arrangement in rows or in contact with neighboring elements is not required.

A given element 22 has a major surface 22*a* which includes a major dimension of the element, as well as an edge surface 22*b* including a minor dimension (thickness) of the element, exposed directly to sound waves produced within the machinery enclosure. Portions 12a of the reflective surface 12 are also exposed between neighboring elements 20,22,24 and 26 by gaps created inherently between adjacent elements due to their respective shapes and/or by spacing the elements apart on the surface 12.

One contributing factor to the greater efficiency of a given area of acoustical absorbent material when applied in an appropriate spaced arrangement is considered to be an increase in the exposed surface area. Accordingly, the sum of the exposed major surface 22*a* and edge surface 22*b* for each of a plurality of elements 22 according to one aspect of the present invention desirably exceeds the area of the reflecting surface 12 to which they are mounted. In the prior art that surface 12 would typically have been substantially covered by an equivalent area of acoustical absorbent material.

Figure 2:
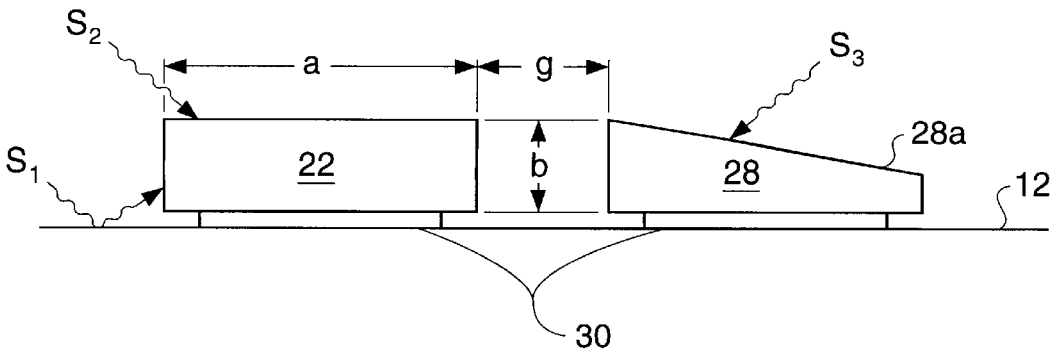
FIG. 2 is illustrative of the edge effect believed to occur when portions of a reflective surface are exposed by spaced arrangement of acoustical absorption elements.

FIG. 2 is a cross-sectional view of acoustical absorption elements 22, 28 mounted to a reflective surface 12 by attachment structure 30. Sound energy, depicted as waves $S_1$, $S_2$, $S_3$, emanate from the machinery (not shown) and are at least partially absorbed by acoustic absorption elements 22,28.

It will be understood by those skilled in the art that waves $S_1$, $S_2$, $S_3$ are merely representative of the acoustical energy inherent with respect lo the noise emanating from within the enclosure and that noise consists of primarily of a series of random displacements with little semblance of regularity of any kind. Furthermore, the term sound or acoustical energy absorption is well known in the art to mean that such energy changes into another form, generally heat, when it contacts a solid body, such as absorption element 22 and, to a lesser extent, reflecting surface 12.

As further depicted in FIG. 2, a sound wave $S_2$ may directly impinge upon a major or edge surface of an element 22, or may first strike reflecting surface 12 before impinging on an element 22, as depicted by wave $S_1$. This absorption, possibly including a diffraction effect, is believed to contribute to the increased performance found when the edge surfaces are exposed, although the phenomenon is not entirely understood.

In an alternative embodiment, an element 28 may be formed in such a manner that an exposed major surface 28*a*, which includes a major dimension (a), is oblique to the reflecting surface 12. The exposed major surface is typically the surface opposite the face of the element upon which it is mounted to the reflective surface. For example, a minor dimension (b), referred to herein as thickness, may taper down between opposing edges. Providing an oblique major surface is believed to increase the opportunity for a wave $S_3$, travelling substantially parallel to the surface 12, to impinge upon an element 28. Furthermore, waves striking a surface at an oblique angle are more completely absorbed, because less energy is reflected back from the surface.

Attachment structure 30 may include a mechanical, adhesive, or similar fastener, but preferably is of a nature which permits easy removal and reapplication of each element 22 from the enclosure surface 12. Absorption element 22 may be exposed to extreme temperatures, mud, and airborne dirt, therefore removal for cleaning or replacement may at times be necessary.

According to one embodiment for use with metal machinery enclosures, structure 30 includes a permanent magnet permanently attached to each absorption element 22. Alternatively, a hook and loop fastener such as VELCRO® may be applied to the enclosure surfaces 12 and element 20. An advantage of the present invention lies in the ability of the installer to arrange a plurality of elements in a desired pattern, while permitting placement in a manner to avoid machinery protrusions or any radically curved portions of the enclosure surface 12. Since it is relatively expensive to manufacture contoured acoustical absorption panels, a protrusion near the enclosure wall often dictated that the whole panel be made thinner, thereby reducing low frequency absorption effectiveness.

INDUSTRIAL APPLICIBILITY

The present invention is now described in relation to its use in the machinery enclosure of an earthmoving machine, for which noise regulations are becoming increasingly stringent. Earthmoving machines commonly have comparatively large diesel engines producing substantial acoustical energy at relatively low frequencies. Conventional wisdom suggests that the outer face of the acoustical absorbent material be spaced from the reflective surface by at least one quarter wavelength of the lowest frequency to be absorbed. Accordingly, a thickness (b) of about one to two inches will substantially absorb the low frequencies of interest. As mentioned previously, it is not necessary that each absorbent element be of identical thickness. In fact, it may be desirable to vary the size and thickness of some elements within the array in order to tune the system for absorption of specific known frequencies, or simply to provide some extra thickness for low frequency absorption in those locations where sufficient clearance exists.

Such variations are considered to be within the scope of the present invention.

The machinery enclosure typically includes a relatively large area of reflective surfaces, therefore a minimum of six inches in a major dimension (a) is desirable, regardless of the shape, in order to avoid unnecessarily increasing installation times. For example, major dimension (a) for a rectangular element 22 would be the length of the longest side, which may equal the width (square), whereas major dimension (a) for an elliptical element 22 would be is the length of the major axis, that being the diameter if circular. Elliptical elements always provide a sloping upper surface when installed on a vertical wall, advantageously helping reduce accumulation of debris on the element.

While increasing the spacing between neighboring elements initially improves the absorption per unit area of absorbent material, the increase levels off at some spacing level for any given frequency. Furthermore, increased spacing reduces the total amount of absorbent material area available within a given-sized machinery enclosure. A spacing (g) no greater than one third of a major dimension (a) of each absorbent element has been found to provide satisfactory performance for the range of sizes discussed herein.

While certain present preferred embodiments of the invention and certain present preferred methods of practicing the same have been illustrated and described herein, it is to be distinctly understood that the invention is not limited thereto but may be otherwise variously embodied and practiced within the scope of the following claims.

What is claimed is:

1. A system for attenuating sound reverberations within a machinery enclosure, the enclosure having acoustically reflective surfaces, the system comprising:

a plurality of elements composed of acoustic absorbent material mounted within the enclosure in a two-dimensional spaced array on at least one of said reflective surfaces, wherein portions of the reflective surface are exposed between neighboring elements.

2. The system of claim 1, wherein the total exposed surface area of said plurality of absorbent elements mounted to a said reflective surface is greater than the area of said surface.

3. The system of claim 1, further comprising structure for removable attachment of each of said plurality of elements to the enclosure surface in order to permit cleaning and replacement of the elements.

4. The system of claim 3, wherein said reflective surface is a metal panel and said structure for removable attachment comprises magnetic material.

5. The system of claim 3, wherein and said structure for removable attachment comprises a hook and loop arrangement.

6. The system of claim 3, wherein at least one of said plurality of elements is formed to attach to the reflective surface of the enclosure in a manner to present a major surface opposite the mounting face of the element at an angle oblique to the reflective surface.

7. The system of claim 1, wherein said plurality of elements are of substantially similar size and shape.

8. The system of claim 1, wherein at least some of the plurality of elements are of a different thickness than others of said elements in order to accommodate variation in the principle range of frequencies to be absorbed.

9. The system of claim 1, wherein at least some of the plurality of elements are of a different size than others of said elements in order to accommodate variation in the principle range of frequencies to be absorbed.

10. The system of claim 1, wherein the plurality of elements are at least one of elliptical and rectangular in shape.

11. The system of claim 1, wherein the plurality of elements have a constant thickness of about one to two inches.

12. The system of claim 1, wherein a major dimension of each element is at least six inches, and the inter element spacing does not exceed one third of the major dimension.

13. The system of claim 1, wherein said plurality of elements are formed of fiberglass batting.

14. A system for attenuating sound reverberations within a machinery enclosure, the enclosure having acoustically reflective surfaces, the system comprising:

a plurality of acoustical absorption elements composed of acoustical absorbent material mounted within the enclosure in a two-dimensional spaced array on at least one of said reflective surfaces, wherein portions of the reflective surface are exposed between neighboring elements; and structure for removable attachment of each of said plurality of elements to the enclosure surface in order to permit cleaning and replacement of the elements.

15. The system of claim 14, wherein at least one of said plurality of elements is formed to attach to the reflective surface of the enclosure in a manner to present a major surface opposite the mounting face of the element at an angle oblique to the reflective surface.

16. A system for attenuating sound reverberations within a machinery enclosure, the enclosure having acoustically reflective surfaces, the system comprising:

A plurality of elements consisting of acoustical absorbent material mounted within the enclosure in a two-dimensional spaced array on at least one of said reflective surfaces and, wherein a major face of the material opposite the face mounted to said surface is exposed to sound energy generated by machinery within the enclosure to provide viscous damping thereof.

17. The system of claim 16, wherein a major dimension of each element is at least six inches, and the inter element spacing does not exceed one third of the major dimension.

18. The system of claim 16, wherein at least some of the plurality of elements are of a different thickness than others of said elements in order to accommodate variation in the principle range of frequencies to be absorbed.

19. The system of claim 16, wherein at least one of said plurality of elements is formed to attach to the reflective surface of the enclosure in a manner to present a major surface opposite the mounting face of the element at an angle oblique to the reflective surface.

20. The system of claim 1, wherein each element has a major surface which includes a major dimension of the element, and an edge surface which includes a minor dimension of the element, said surfaces being exposed directly to sound waves produced within the machinery enclosure.

* * * * *